United States Patent [19]

Brusky

[11] Patent Number: 4,749,516

[45] Date of Patent: Jun. 7, 1988

[54] ANIONIC EMULSION PRE-SPOTTING COMPOSITION

[75] Inventor: Jeanne A. Brusky, Racine County, Wis.

[73] Assignee: S. C. Johnson & Son, Inc., Racine, Wis.

[21] Appl. No.: 779,726

[22] Filed: Sep. 24, 1985

[51] Int. Cl.[4] ..... C11D 3/18; C11D 1/34; C11D 3/04; C11D 1/83

[52] U.S. Cl. ..... 252/546; 252/135; 252/153; 252/170; 252/171; 252/527; 252/DIG. 1; 252/DIG. 11; 252/DIG. 14; 252/DIG. 19; 252/143

[58] Field of Search ..... 252/525, 544, 546, 173, 252/174.21, 527, 153, 170, 171, 173, 143 DIG. 1, DIG. 11, DIG. 14, DIG. 19

[56] References Cited

U.S. PATENT DOCUMENTS

| | | | |
|---|---|---|---|
| Re. 29,649 | 5/1978 | Farnsworth | 252/171 |
| 3,533,955 | 10/1970 | Pader et al. | 252/118 |
| 3,748,268 | 7/1973 | Loudas | 252/90 |
| 3,795,624 | 3/1974 | Feinstone | 252/91 |
| 3,869,412 | 3/1975 | Waag | 252/527 |
| 3,899,436 | 8/1975 | Copeland | 252/99 |
| 3,915,633 | 10/1975 | Ramachandran | 8/137 |
| 3,941,713 | 3/1976 | Dawson et al. | 252/142 |
| 3,959,165 | 5/1976 | Yurko | 252/109 |
| 4,093,418 | 6/1978 | Compton et al. | 8/142 |
| 4,147,652 | 4/1979 | Kaniecki | 252/156 |
| 4,152,305 | 5/1979 | Berghausen, III | 252/135 |
| 4,176,080 | 11/1979 | Wise | 252/162 |
| 4,178,262 | 12/1979 | Compton et al. | 252/99 |
| 4,180,472 | 12/1979 | Mitchell et al. | 252/162 |
| 4,362,638 | 12/1982 | Caskey et al. | 252/90 |
| 4,414,128 | 7/1973 | Goffinet | 252/111 |
| 4,438,009 | 3/1984 | Brusky | 252/90 |
| 4,530,781 | 7/1985 | Gipp | 252/546 |

*Primary Examiner*—Paul Lieberman
*Assistant Examiner*—John F. McNally

[57] ABSTRACT

A two-phase low solvent anionic water-in-oil detergent emulsion to be applied to fabrics as laundry pre-spotting compositions. The composition comprises from 1% to 30% by weight of a salt; from about 1 to about 35% by weight of a mixture of about 0.1% to 2% by weight of a sorbitan nonionic surfactant and from about 0.5% to 30% by weight of at least one other nonionic surfactant and with soluble anionic surfactants. The composition has an HLB of from about 8 to about 14 and is poised at the phase inversion point of an oil-out/water-out emulsion. The composition also includes from about 2% to 60% by weight of a solvent. The balance of the composition is comprised of preferably deionized water.

14 Claims, No Drawings

ANIONIC EMULSION PRE-SPOTTING COMPOSITION

BACKGROUND OF THE INVENTION

1. Field of the Invention

This invention relates to a two-phase aqueous laundry pre-spotting composition. More particularly, this invention relates to a two-phase aqueous emulsion pre-spotting composition containing a relatively low amount of solvent having superior cleaning and stain removal properties. Specifically, this invention relates to an aqueous anionic two-phase pre-spotter composition having a clear upper phase and a cloudy lower phase. The emulsion, when in proper form, is a water-in-oil, and just approaching an oil-in-water composition, whereby both water-borne and oil-borne stains are removed.

Currently, commercially available pre-spotting compositions fall into two main categories: aqueous-based and solvent-based. The aqueous-based pre-spotting compositions are primarily non-aerosol formulations dispensed from trigger spray bottles or squeeze bottles onto the fabric before they are laundered. Typically, aqueous-based pre-spotting compositions have good stain removal against so-called "water-borne" stains. These stains include a variety of stains such as grape juice, mustard, grass, chocolate, clay, and similar stains.

The solvent-based formulations typically have been packaged in aerosol form. The solvent-based pre-spotting compositions typically are more effective in removing "oil-borne" stains such as cooking oil, fat, sebum, grease, motor oil and the like. Solvent-based pre-spotting compositions can be formulated with adequate water-borne stain removal. However, it is desirable to utilize an emulsion containing both solvents and water so as to be able to attack both water-borne and oil-borne stains.

Lately, because of the increased cost of various solvents utilized in solvent-based pre-spotters, there has been great emphasis on lessening the amount of solvent utilized and replacing this with other less expensive components, such as water. In addition, it has been desirable to prepare a pre-spotting composition which contains a high degree of water and yet will attack both water-borne and oil-borne stains on laundry fabrics.

Brusky, et al., U.S. Pat. No. 4,438,009, discloses a water-in-oil detergent emulsion for use as a detergent pre-spotting composition. The composition of Brusky contains a sorbitan nonionic surfactant as a stabilizer for the system, as well as other nonionic surfactants which aid in the removal of those oil-borne and water-borne stains and utilizes a relatively low amount of solvent in addition to the mixture of nonionic surfactants. The present invention differs from Brusky, et al., in that the present invention is an oil-out/just approaching a water-out formulation containing anionic surfactants, as well as a number of other ingredients. Accordingly, the present invention differs from and is an improvement over the Brusky, et al., disclosure.

Mitchell, et al., U.S. Pat. No. 4,180,472, discloses an oily-soil-dissolving agent consisting essentially of a water-insoluble solvent, a water-in-oil emulsifiable solvent, and water with other detergent builders. The Mitchell disclosure depends upon a two part treatment wherein the user first places a solvent having an anionic surfactant on the article to be laundered, and then, in a separate step, adds a water anionic system to remove the solvent residual. The present invention accomplishes these twin aims in a single application. Furthermore, there is no mention in the Mitchell disclosure of creating a composition having an HLB such that the composition, as a whole, is at the water-out/oil-out phase inversion point. Accordingly, the present invention differs greatly from and is an improvement over Mitchell, et al.

Wise, et al., U.S. Pat. No. 4,176,080, discloses a detergent composition similar to the Mitchell disclosure. The Wise disclosure employs a sequential treatment of fabrics in an aqueous washing medium with first, a water-insoluble solvent, and second, a composition comprising a water-soluble surfactant with an HLB of about 11–18.

The present invention differs from Wise, et al., in that Wise is limited only to the removal of oil-borne stains and exceeds the low solvent amounts of the present invention. Accordingly, the present invention differs from and is an improvement over Wise, et al.

Ramachandran, U.S. Pat. No. 3,915,633 relates to a pre-wash composition adapted to be sprayed on a soiled fabric before washing. The composition consists of an organic complexing acid, a surfactant, and water.

Ramachandran does not disclose the use of a sodium hydroxide, a free acid form of a complex organic phosphate ester, an isoparaffinic solvent or d-Limonene in a pre-wash composition. Further, the composition of Ramachandran is not in the form of an emulsion and does not utilize anionic surfactants. Accordingly, the present invention differs from and is an improvement over Ramachandran.

SUMMARY OF THE INVENTION

The present invention is a system with the oil phase on top and the water phase on the bottom and is meant to be used in a shaker or mixed form. Furthermore, this invention is directed to an emulsion that is oil-out approaching water-out which is poised at the phase inversion point such that the HLB of the system is oil-out just approaching a water-out emulsion. This composition comprises a salt selected from various classes of salts, a mixture of anionic surfactants as cleaners, and nonionic surfactants, including a small percentage of a sorbitan nonionic composition as a stabilizer, solvent and water. The formulation is further characterized by using a system wherein it is an oil-out/just approaching a water-out and having an HLB point poised at the phase inversion point. A composition formed according to the present invention is useful both as an aerosol composition and as a pump spray or squeeze bottle spray composition.

DETAILED DESCRIPTION OF THE PREFERRED EMBODIMENT

The composition of the present invention comprises a water-in-oil approaching an oil-in-water anionic emulsion to be applied to fabrics as a laundry pre-treating composition comprising from about 1 to about 30% by weight of a salt selected from the group consisting of citrates, gluconates, borates, silicates, phosphates, chlorides, carbonates and mixtures thereof. Suitable salts include citrate, gluconate, borate, the salts of ethylenediamine tetraacetic acit (EDTA) such as ethylenediaminetetraacetric acid disodium salt, ethylenediaminetetraacetric acid diammonium salt, ethylenediaminetetraacetic acid trisodium salt, ethylenediaminetetraacetric acid tetrasodium salt, ethylenediaminetetraacetric acid tetrapotassium salt, ethylenediaminetetraacetric acid tetrammonium salt, etc., silicate, phosphate, chloride, carbonate and mixtures thereof, and from about 1 to about 35% by weight of a mixture of (i) about 0.1 to about 2% by weight of a sorbitan nonionic surfactant selected from the group consisting of sorbitan monooleate, sorbitan monolaurate, sorbitan trioleate, and mixtures thereof, and (ii) from about 0.5 to about 30% of at least one other nonionic surfactant and anionic surfactants selected from the group consisting of water-soluble anionic surfactants such as Aerosol OTS-S which is the tradename for dioctyl sodium sulfosuccinate, or Gafac RM-410, which is the tradename for nonylnonoxynol-7 phosphate, said mixture having an HLB of from about 8 to about 14, such that the entire system is poised at the phase inversion point of a oil-out/water-out emulsion. The composition further includes from about 5 to about 60% by weight of the solvent; and from about 10 to about 75% by weight water.

The laundry pre-treating composition of the present invention is basically an oil-in-water/water-in-oil emulsion. Seemingly, this is two phases within one and it is to be understood that the present invention is an emulsion consisting of two phases poised at the phase inversion point between water-out and oil-out emulsion. It is critical that the composition be poised at this phase inversion point so that the different phases will perform their respective jobs without transferring one within the other. Specifically, the oily phase, which is the clear portion, is best suited to attack oil-borne stains, but will set water-borne stains into the fabric, whereas the water-out phase attacks the water-borne stains, but will not remove oil stains. By poising the shaken or mixed emulsion at the inversion point between oil-out and water-out, it is possible to incorporate the two different forms of spot removers within one composition for ease of use.

The entire composition may be placed in an aerosol container, as well as in a squeeze, pump or trigger applicator. It must be noted that oil-in-water emulsions in the previous art contained nonionic surfactants which are temperature sensitive. These surfactants are sprayed as foams rather than aerosols when the temperature approches 50° F. and the emulsion inverts to a water-out emulsion. The composition then loses its oil stain removal capability.

The present invention does not suffer from this setback because of its anionic surfactants.

The first component of the composition of the present invention is a salt. These salts provide a variety of characteristics to the final product, reduction of soil redeposition and increased performance, i.e., stain removal for oil and fruit stains. The salts serve a dual function of aligning the system so the surfactants are in the oil phase. Suitable salts include citrate, gluconate, borate, the salts of ethylenediamine tetraacetic acid (EDTA) such as ethylenediaminetetraacetric acid disodium salt, ethylenediaminetetraacetric acid diammonium salt, ethylenediaminetetraacetric acid trisodium salt, ethylenediaminetetraacetric acid tetrasodium salt, ethylenediaminetetraacetric acid tetrapotassium salt, ethylenediaminetetraacetric acid tetrammonium salt, etc., silicate, phosphate, chloride, carbonate and mixtures thereof.

Specific salts in the above classes which are particularly preferred include sodium citrate, sodium gluconate, borax, sodium silicate, sodium tripolyphosphate, sodium chloride, sodium sesquicarbonate, sodium carbonate, sodium pyrophosphate, potassium chloride, magnesium chloride, zinc ammonium citrate and mixtures thereof. The most preferred salts are sodium citrate, borax, sodium silicate, sodium tripolyphosphate and sodium pyrophosphate for aerosol-type compositions, as the other salts can create corrosion problems. For non-aerosol compositions, preferred salts include sodium citrate, potassium chloride, sodium chloride, magnesium chloride, mixtures thereof, and the like.

These salts must be present in the composition of the present invention in an amount of about 1% by weight. By and large, the upper limit of salt content is dependent upon the solubility of the salts and can reach as high as 30% for some selected highly water-soluble or oil-soluble salts. The preferred amount of salt present in the composition is from about 2.5 to 30% and most preferably from about 2.5 to 7%. In amounts greater than 7%, for most salts, the increase in the performance is relatively negligible, while increased cost resulting from the added salt far outweights any increased benefit. Accordingly, for most applications, less than 7% salt will be utilized.

The compositions of the present may also include a mixture of nonionic surfactants. These nonionics are present in miniscule amounts and are present only to help stabilize the emulsion water-out portion of this system. The first component of the nonionic surfactant mixture is a sorbitan surfactant, such as sorbitan monolaurate, sorbitan monooleate, sorbitan trioleate and mixtures thereof.

As an additional nonionic surfactant, it is often desirable to incorporate in a small amount, i.e. from 0.1 to 3% by weight of an ethoxylated sorbitan nonionic such as those sold under the tradename Tweens from ICI America. Suitable nonionics include ethoxylated sorbitan monolaurate plus 20 moles of ethylene oxide, ethoxylated sorbitan monopalmitate with 20 moles ethylene oxide, ethoxylated sorbitan monosterate with 20 moles ethylene oxide, ethoxylated sorbitan monooleate with 20 moles ethylene oxide and mixtures thereof. The Tween type ethoxylated sorbitan nonionics, when combined with the nonethoxylated sorbitan nonionics in appropriate amounts, provide excellent emulsion stability, and increased stain removal performance for the oil-out portion of the emulsion and still retain improved inhibition of soil redeposition. Other nonionic surfactants include the ethoxylated nonylphenols such as Surfonic N series available from Jefferson Chemical, the ethoxylated octophenols, including the Triton X series available from Rohm and Haas, the ethoxylated secondary alcohols such as Tergitol series available from Union Carbide, the ethoxylated primary alcohol series, such as the Neodols available from Shell Chemical, the polymeric ethylene oxides such as the Pluronics available from BASF Wyandotte.

In addition to the nonionic surfactants, the main surfactants utilized in this invention are the anionic surfactants. The anionic surfactants should be selected from the group consisting of water soluble anionic surfactants such as Aerosol OT-S which is a tradename for dioctyl sodium sulfosuccinate, or Gafac RM-410, which is the tradename for nonylnonoxynol-7 phosphate, said mixture having an HLB of from about 9 to 14.5 such that the entire system is poised at the phase invention point of a oil-out/water-out emulsion. Other anionic surfactants include: di-isobutyl ester of sodium sulfosuccinic acid, disodium ethoxynonylphenol half ester of sulfosuccinic acid, diamyl ester of sodium sulfosuccinic acid, dihexyl ester of sodium sulfosuccinic acid, dioctyl ester of sodium sulfosuccinic acid, alkyl aryl sulphonate, alkyl amine sulphonate, sodium salt of lauryl ether sulphate, isopropylamine sulphonate, disodium N-lauryl beta-amino-diproprionate, phosphated esters, mono carboxylic coco derivative, modified alkanolamides, short chain alkanolamides, dioctyl sodium sulfosuccinate, ditridecyl sodium sulfosuccinate, tetra sodium dicarboxyethyl octodecyl sulfosuccinimate, amine alkylaryl sulphonate, sodium petroleum sulphonate, sodium cetyl/stearate sulphate, sodium alpha-olefin sulphonates (AOS), sodium 2-ethylhexyl sulfate, sodium lauryl sulfate (SLS), sodium alkylaryl sulphonate, modified ethox, sodium cumine sulphonate, coco amido betaine, modified sulphobetaine, amine salt dodecylbenzene sulphonate, and triethanolamine (T.E.A.), tridecylbenzene sulphonate.

The compositions of the present invention also include a hydrocarbon solvent. Suitable hydrocarbon solvents include isoparaffinic hydrocarbons, including mixed $C_{10}$ to $C_{12}$ isoparaffinic hydrocarbon sold under the tradename Isopar by Exxon Chemicals, Houston, Tex. These isoparaffinic hydrocarbons are branched chained fully saturated hydrocarbons and are characterized by boiling range. These mixtures are available in boiling ranges of from 90° C. to 210° C. In addition to the isoparaffinic hydrocarbons, low odor petroleum solvent having a boiling range of 195° C. to 250° C., kerosene, pine oil, naptha and d-Limonene are also acceptable. From an odor standpoint, the isoparaffinic hydrocarbons are preferred as these materials are low in odor. However if odor is not a consideration, substantially any of the above solvents can be utilized. For a variety of reasons, it is preferred to utilize certain relatively high boiling point solvents so that the solvent is in contact for some time with the stain and so that the flamability of any product formulated is somewhat reduced. It is preferred to use an isoparaffinic hydrocarbon solvent having a boiling range of from about 157° C. to about 210° C. and most preferably from 176° C. to 188° C.

These solvents utilized in the composition of the present invention can be present in an amount of about 2% to 60% by weight and preferably from 10% to 40% and most preferably from 15% to 30% by weight. It is most preferable that since solvents are relatively expensive and a petroleum resource, a minimum amount of solvent will be utilized in the composition of the present invention while at the same time maintaining oily stain removal. For this reason, anionics are presented to reduce the amount of the solvent needed in the composition.

The last component of the composition of the present invention is water. Water is the filler or bulk medium and enables cleaning of water borne stains. The water is present in an amount of from 0 to 90% by weight and preferably from 30 to 70% by weight.

In addition to the above components, compositions of the present invention may include a number of other ingredients such as perfumes, corrosion inhibitors, defoamers, bactericides, bacteristats, and the like. These materials are generally present in amounts of less than 1% by weight, based on the weight of the composition.

If the composition is to be used in an aerosol form, the typical aerosol compositions include from about 70% to 90% of the composition of the present invention and from about 10% to 30% of a propellent. Any of the typical aerosol propellents, such as hydrocarbon, halengenated hydrocarbon, and compressed gases can be used. Suitable propellents include propane, butane, isobutane, pentane, propellent 11, propellent 12, propellent 14, and the like. Preferred propellents are the hydrocarbon propellents as other propellents may interact with the water to cause corrosion problems. The prespotting compositions of the present invention will now be illustrated by the following examples, wherein all parts and percentages are by weight and all temperatures are in degrees celsius, unless otherwise indicated.

The following examples are offered by way of illustration of the present invention without limiting the scope or spirit of the invention.

EXAMPLE 1

| Material | A | B | C |
|---|---|---|---|
| Water | 64.90 | 62.90 | 60.90 |
| Citric Acid | 5.00 | 5.00 | 5.00 |
| NaOH | 3.10 | 3.10 | 3.10 |
| Aerosol OT-S | 6.00 | 6.00 | 6.00 |
| Gafac RM410 | | 2.00 | 2.00 |
| Isopar K | 20.00 | 20.00 | 20.00 |
| Span 80 | | | 0.60 |
| Tween 80 | | | 1.40 |
| Limonene | 1.00 | 1.00 | 1.00 |
| | 100.00 | 100.00 | 100.00 |
| FORM | | | |
| (Initial) | Emulsion | Emulsion | Emulsion |
| (Aged) | 2 Clear | OK | OK |
| *Stain Removal | 3.5 | 3.0 | 3.5 |

*Stain Removal - A composite five point scale based on ten stains and five fabrics. 1.0 is no removal, 3.0 is the performance of commercial prespotting compositions and 5.0 is complete removal. Stains were used motor oil, mustard, chocolate, spagetti sauce, clay dispersion, grass slurry, artificial Cuff 'n Collar, mazola oil, butter and blood. Fabrics used were 100% cotton, 65/35 polyester/cotton blend, 50/50 polyester/cotton blend, 100% polyester and 65/35 polyester/cotton blend in light blue for oil based stains.

Samples were prepared incorporating various components in the system. Sample A has good stain removal but stability is not desirable. By adding the Gafac RM-410, in Sample B, stability is satisfactory but stain removal is lessened. By adding the proper HLB ratio of Span/Tween, in Sample C, stability remains satisfactory and stain removal increases.

EXAMPLE 2

| Material | A | B |
|---|---|---|
| Water | 63.51 | 52.25 |
| Citric Acid | 2.60 | 16.09 |
| NaOH | 1.61 | 9.97 |
| Aerosol OT-S | 6.25 | 1.60 |
| Gafac RM410 | 2.08 | 1.60 |
| Isopar K | 20.84 | 16.09 |
| Span 80 | 0.62 | 0.48 |
| Tween 80 | 1.45 | 1.12 |
| Limonene | 1.04 | 0.80 |
| | 100.00 | 100.00 |
| FORM | | |
| (Initial) | Clear | Emulsion |
| (Aged) | Translucent | OK |
| *Stain Removal | 2.0 | 3.5 |

*Stain Removal - A composite five point scale based on ten stains and five fabrics. 1.0 is no removal, 3.0 is the performance of commercial prespotting compositions and 5.0 is complete removal. Stains were used motor oil, mustard, chocolate, spagetti sauce, clay dispersion, grass slurry, artificial Cuff 'n Collar, mazola oil, butter and blood. Fabrics used were 100% cotton, 65/35 polyester/cotton blend, 50/50 polyester/cotton blend, 100% polyester and 65/35 polyester/cotton blend in light blue for oil based stains.

Samples based on Sample C of Example 1 were prepared varying the amount of salt. In sample A, not enough salt is present to align the system and force an oil-out emulsion. This is evident because of its translucency and low stain removal score. Sample B shows an increased salt content which has good stability and stain removal, but is not cost effective.

EXAMPLE 3

| Material | A | B |
|---|---|---|
| Water | 63.47 | 53.46 |
| Citric Acid | 5.20 | 4.38 |
| NaOH | 3.23 | 2.72 |
| Aerosol OT-S | 2.08 | 17.54 |
| Gafac RM 410 | 2.08 | 1.75 |
| Isopar K | 20.83 | 17.54 |
| Span 80 | 0.62 | 0.52 |
| Tween 80 | 1.45 | 1.22 |
| Limonene | 1.04 | 0.87 |
| | 100.00 | 100.00 |
| FORM | | |
| (Initial) | Translucent | Emulsion |
| (Aged) | 1 Phase Hazy | OK |
| *Stain Removal | 2.0 | 3.75 |

*Stain Removal - A composite five point scale based on ten stains and five fabrics. 1.0 is no removal, 3.0 is the performance of commercial prespotting compositions and 5.0 is complete removal. Stains were used motor oil, mustard, chocolate, spagetti sauce, clay dispersion, grass slurry, artificial Cuff 'n Collar, mazola oil, butter and blood. Fabrics used were 100% cotton, 65/35 polyester/cotton blend, 50/50 polyester/cotton blend, 100% polyester and 65/35 polyester/cotton blend in light blue for oil based stains.

Samples are again based on Sample C of Example 1 and the amount of Aerosol OT-S is varied. Low level results in a water-out emulsion having little stain removal while higher levels increase stain removal, but is also not cost effective.

EXAMPLE 4

| Material | A | B |
|---|---|---|
| Water | 62.17 | 51.67 |
| Citric Acid | 5.10 | 4.23 |
| NaOH | 3.16 | 2.62 |
| Aerosol OT-S | 6.12 | 5.08 |
| Gafac RM 410 | 0.00 | 16.94 |
| Isopar K | 20.40 | 16.94 |
| Span 80 | 0.61 | 0.50 |
| Tween 80 | 1.42 | 1.18 |
| Limonene | 1.02 | .84 |
| | 100.00 | 100.00 |
| FORM | | |
| (Initial) | Emulsion | Thick |
| (Aged) | 2 Clear | 1 Phase Thick |
| *Stain Removal | 3.0 | 3.75 |

*Stain Removal - A composite five point scale based on ten stains and five fabrics. 1.0 is no removal, 3.0 is the performance of commercial prespotting compositions and 5.0 is complete removal. Stains were used motor oil, mustard, chocolate, spagetti sauce, clay dispersion, grass slurry, artificial Cuff 'n Collar, mazola oil, butter and blood. Fabrics used were 100% cotton, 65/35 polyester/cotton blend, 50/50 polyester/cotton blend, 100% polyester and 65/35 polyester/cotton blend in light blue for oil based stains.

Low amounts of Gafac RM-410 in these samples resulted in lower stain removal while higher levels also hurt stain removal because sample is too oil-out and sets $H_2O$ based stains.

EXAMPLE 5

| Material | A | B |
|---|---|---|
| Water | 71.69 | 43.54 |
| Citric Acid | 5.88 | 3.57 |
| NaOH | 3.64 | 2.21 |

-continued

| Material | A | B |
|---|---|---|
| Aerosol OT-S | 7.05 | 4.28 |
| Gafac RM 410 | 2.35 | 1.42 |
| Isopar K | 5.88 | 42.85 |
| Span 80 | 0.70 | 0.42 |
| Tween 80 | 1.64 | 1.00 |
| Limonene | 1.17 | 0.71 |
| | 100.00 | 100.00 |
| FORM | | |
| (Initial) | Emulsion | Foamy |
| (Aged) | OK Thick | OK |
| *Stain Removal | 3.5 | 4.5 |

*Stain Removal - A composite five point scale based on ten stains and five fabrics. 1.0 is no removal, 3.0 is the performance of commercial prespotting compositions and 5.0 is complete removal. Stains were used motor oil, mustard, chocolate, spagetti sauce, clay dispersion, grass slurry, artificial Cuff 'n Collar, mazola oil, butter and blood. Fabrics used were 100% cotton, 65/35 polyester/cotton blend, 50/50 polyester/cotton blend, 100% polyester and 65/35 polyester/cotton blend in light blue for oil based stains.

Varying the solvent level in these samples showed good stain removal at the low end but sample is thick and less convenient. High end sample has excellent stain removal because it does so well on oil-based stains.

EXAMPLE 6

| Material | A | B | C | D |
|---|---|---|---|---|
| Water | 61.17 | 60.30 | 60.09 | 58.39 |
| Citric Acid | 5.02 | 5.03 | 4.93 | 4.78 |
| NaOH | 3.11 | 3.11 | 3.05 | 2.96 |
| Aerosol OT-S | 6.02 | 6.03 | 5.91 | 5.74 |
| Gafac RM 410 | 2.00 | 2.01 | 1.97 | 1.91 |
| Isopar K | 20.08 | 20.12 | 19.72 | 19.15 |
| Span 80 | 0.20 | 0.00 | 1.97 | 4.78 |
| Tween 80 | 1.40 | 1.40 | 1.38 | 1.34 |
| Limonene | 1.00 | 1.00 | .98 | .95 |
| | 100.00 | 100.00 | 100.00 | 100.00 |
| FORM | | | | |
| (Initial) | Emulsion | Emulsion | Oily | Oily |
| (Aged) | OK | OK | 2 Clear | 2 Clear |
| *Stain Removal | 3.0 | 3.0 | sauce, 4.0 | 3.0 Sets $H_2O$ Based Stains |

*Stain Removal - A composite five point scale based on ten stains and five fabrics. 1.0 is no removal, 3.0 is the performance of commercial prespotting compositions and 5.0 is complete removal. Stains were used motor oil, mustard, chocolate, spagettisauce, clay dispersion, grass slurry, artificial Cuff 'n Collar, mazola oil, butter and blood. Fabrics used were 100% cotton, 65/35 polyester/cotton blend, 50/50 polyester/cotton blend, 100% polyester and 65/35 polyester/cotton blend in light blue for oil based stains.

Amount of Span 80 was varied. At low levels, reasonable stain removal is achieved but stability could be improved. At high levels, emulsion is very oily and sets in $H_2O$ based stains.

EXAMPLE 7

| Material | A | B | C |
|---|---|---|---|
| Water | 61.74 | 58.82 | 59.97 |
| Citric Acid | 5.06 | 4.82 | 4.92 |
| NaOH | 3.14 | 2.99 | 3.05 |
| Aerosol OT-S | 6.07 | 5.79 | 5.90 |
| Gafac RM410 | 2.02 | 1.93 | 1.96 |
| Isopar K | 20.26 | 19.30 | 19.68 |
| Span 80 | .60 | 0.57 | .59 |
| Tween 80 | .10 | 4.82 | 2.95 |
| Limonene | 1.01 | 0.96 | 0.98 |
| | 100.00 | 100.00 | 100.00 |
| FORM | | | |
| (Initial) | Emulsion | Clear | Clear |
| (Aged) | OK | Clear | Translucent |

-continued

| Material | A | B | C |
|---|---|---|---|
| *Stain Removal | 3.5 | 2.0 | 2.5 |

*Stain Removal - A composite five point scale based on ten stains and five fabrics. 1.0 is no removal, 3.0 is the performance of commercial prespotting compositions and 5.0 is complete removal. Stains were used motor oil, mustard, chocolate, spagetti sauce, clay dispersion, grass slurry, artificial Cuff 'n Collar, mazola oil, butter and blood. Fabrics used were 100% cotton, 65/35 polyester/cotton blend, 50/50 polyester/cotton blend, 100% polyester and 65/35 polyester/cotton blend in light blue for oil based stains.

Amount of Tween 80 was varied in these samples. Low levels have good stain removal but stability is not optimum. At high levels a water-out emulsion is formed resulting in lower stain removal.

EXAMPLE 8

| Material | A | B |
|---|---|---|
| Water | 61.53 | 51.21 |
| Citric Acid | 5.05 | 4.20 |
| NaOH | 3.13 | 2.60 |
| Aerosol OT-S | 6.06 | 5.04 |
| Gafac RM 410 | 2.02 | 1.68 |
| Isopar K | 20.20 | 16.80 |
| Span 80 | 0.60 | 0.50 |
| Tween 80 | 1.41 | 1.17 |
| Limonene | .00 | 16.80 |
| | 100.00 | 100.00 |
| FORM | | |
| (Initial) | Emulsion | Emulsion |
| (Aged) | OK | OK |
| *Stain Removal | 3.5 | 4.5 |

*Stain Removal - A composite five point scale based on ten stains and five fabrics. 1.0 is no removal, 3.0 is the performance of commercial prespotting compositions and 5.0 is complete removal. Stains were used motor oil, mustard, chocolate, spagetti sauce, clay dispersion, grass slurry, artificial Cuff 'n Collar, mazola oil, butter and blood. Fabrics used were 100% cotton, 65/35 polyester/cotton blend, 50/50 polyester/cotton blend, 100% polyester and 65/35 polyester/cotton blend in light blue for oil based stains.

This sample varies the use of d-Limonene, which is an auxilary solvent. D-Limonene is not necessary for stain removal but shows increasing stain removal capabilities. However, it is questionable whether it is cost effective.

EXAMPLE 9

| Material | A | B |
|---|---|---|
| Water | 71.94 | 20.39 |
| Citric Acid | 3.59 | 10.18 |
| NaOH | 2.22 | 6.31 |
| Aerosol OT-S | 4.31 | 12.22 |
| Gafac RM 410 | 1.43 | 4.07 |
| Isopar K | 14.37 | 40.73 |
| Span 80 | 0.43 | 1.22 |
| Tween 80 | 1.00 | 2.85 |
| Limonene | .71 | 2.03 |
| | 100.00 | 100.00 |
| FORM | | |
| (Initial) | Emulsion | Foamy (Trans.) |
| (Aged) | OK | OK |
| *Stain Removal | 2.5 | 5.0 |

*Stain Removal - A composite five point scale based on ten stains and five fabrics. 1.0 is no removal, 3.0 is the performance of commercial prespotting compositions and 5.0 is complete removal. Stains were used motor oil, mustard, chocolate, spagetti sauce, clay dispersion, grass slurry, artificial Cuff 'n Collar, mazola oil, butter and blood. Fabrics used were 100% cotton, 65/35 polyester/cotton blend, 50/50 polyester/cotton blend, 100% polyester and 65/35 polyester/cotton blend in light blue for oil based stains.

When varying the amount of water in these samples, low levels resulted in excellent stain removal but are too expensive. High levels have poor stain removal.

What I claim is:

1. A two-phase solvent containing anionic detergent composition to be applied as an unstable water-in-oil emulsion to fabrics as a laundry pre-spotting composition comprising:

(a) from about 1% to about 30% by weight of a water soluble salt selected from the group consisting of citrate, gluconate, borate, silicates, phosphates, chloride, carbonates and salts of ethylenediamine tetra acetic acid and mixtures thereof;

(b) from about 1% to about 35% by weight of a mixture of (i) about 0.1% to about 2% by weight of a sorbitan nonionic surfactant selected from the group consisting of sorbitan monooleate, sorbitan monolaurate, sorbitan trioleate, and mixtures thereof, (ii) about 0.1% to about 3% by weight of at least one other nonionic surfactant, and (iii) from about 0.4 to about 27% by weight of at least one water soluble anionic surfactant, wherein said anionic surfactant is the main component of said mixture, said mixture having an HLB of from about 8 to about 14 and poised at the phase inversion point of an oil-out/water-out emulsion;

(c) from about 2% to 60% by weight of a said solvent selected from the group consisting of naptha, kerosene, d-Limonene, pine oil, isoparaffinic hydrocarbons having a carbon content of about $C_{10}$ to about $C_{12}$ and having a boiling range of from 90° to 120° C., and low odor petroleum solvents having a boiling range of from 195° C. to 250° C., and mixtures thereof; and (d) the balance water.

2. The composition of claim 1 wherein said salt is selected from the group consisting of sodium citrate, potassium chloride, sodium chloride, magnesium chloride and mixtures thereof.

3. The composition of claim 1, wherein said salt is present in an amount of 2.5 to 30% by weight.

4. The composition of claim 1 wherein said salt is present in an amount of about 2.5 to 7% by weight.

5. The composition of claim 1, wherein said other nonionic surfactant is selected from the group consisting of ethoxylated sorbitan monooleate, ethoxylated sorbitan monostearate, ethoxylated sorbitan monooleate, ethoxylated monylphenals, ethoxylated octaphenols, ethoxylated secondary alcohols, ethoxylated primary alcohols, polymeric ethylene oxides and mixtures thereof.

6. The composition of claim 1 wherein said anionic sulfactant is selected from the group consisting of dioctyl sodium sulfosuccinate, nonylnonoxynol-7-phosphate, di-isobutyl ester of sodium sulfosuccinic acid, disodium ethoxynonylphenol half ester of sulfosuccinic acid, diamyl ester of sodium sulfosuccinic acid, dihexyl ester of sodium sulfosuccinic acid, dioctyl ester of sodium sulfosuccinic acid, sodium salt of lauryl ether sulphate, isopropylamine sulphonate, disodium N-lauryl beta-amino-propionate, dioctyl sodium sulfosuccinate, ditridecyl sodium sulfosuccinate, tetra sodium dicarboxyethyl octodecyl sulfosuccinimate, sodium cetyl/stearate sulphate, sodium 2-ethylhexyl sulfate, sodium lauryl sulfate, sodium cumine sulphonate, coco amido betaine, triethanolamine and tridecylbenzene sulphonate.

7. The composition of claim 1, wherein the solvent is present in an amount of from about 10% to 40% by weight.

8. The composition of claim 1, wherein the solvent is present in an amount of from about 15% to 30% by weight.

9. The composition of claim 1 wherein the solvent is an isoparaffinic hydrocarbon having a boiling range of from 157° to 210° C.

10. The composition of claim 1 wherein the water is present in an amount of from about 30% to 70% by weight.

11. The composition of claim 1 wherein from about 90% to 70% by weight of the composition is mixed with from about 10% to 30% by weight of a propellent and said composition is packaged in a pressurized aerosol container.

12. The composition of claim 1 wherein said two phases are comprised of a first phase consisting of a clear oil-in-water emulsion to aid in oil stain removal, and a second phase consisting of an opaque water-in-oil emulsion to aid in water-borne stain removal, said first phase floating upon said second phase and miscible therewith, whereby shaking the composition mixes the two phases in preparation for use as a prespotting composition.

13. The composition of claim 1 wherein said anionic surfactant is selected from the group consisting of sodium salts of esters of sulfosuccinic acid, alkyl aryl sulphonates, alkyl amine sulphonates, phosphated esters, mono-carboxylic coco derivatives, modified alkanolamides, short chain alkanolamides, amine alkylaryl sulphonates, sodium petroleum sulphonates, sodium alpha-olefin sulphonates, sodium alkylaryl sulphonates, modified sulphobetaine, and amine salts of dodecylbenzenesulphonates.

14. The composition of claim 12 wherein said salt is present in an amount of 2.5% to 7% by weight, said solvent is present in an amount of from about 15% to 30% by weight and the solvent is an isoparaffinic hydrocarbon having a boiling range of from 157° to 210° C., and said water is present in an amount of from about 30% to 70% by weight.

* * * * *

UNITED STATES PATENT AND TRADEMARK OFFICE

CERTIFICATE OF CORRECTION

PATENT NO. : 4,749,516

DATED : June 7, 1988

INVENTOR(S) : Jeanne A. Brusky

It is certified that error appears in the above-identified patent and that said Letters Patent is hereby orrected as shown below:

In Column 10, Line 44, the word "monylphenals" should be --nonylphenols--

In Column 10, Line 49, the word "sulfactant" should be --surfactant--.

Signed and Sealed this

Twenty-first Day of March, 1989

*Attest:*

DONALD J. QUIGG

*Attesting Officer*

*Commissioner of Patents and Trademarks*